US006565078B1

(12) United States Patent
Foglino et al.

(10) Patent No.: US 6,565,078 B1
(45) Date of Patent: May 20, 2003

(54) DEVICE FOR FEEDING SHEETS FROM A REAM OF THE TYPE COMPRISING A MAIN FEEDING ROLLER AND AN AUXILIARY SEPARATING ROLLER

(75) Inventors: Roberto Foglino, Montalto Dora (IT); Marco Dellea, Agliè (IT)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 09/958,679

(22) PCT Filed: Apr. 5, 2000

(86) PCT No.: PCT/IT00/00123

§ 371 (c)(1),
(2), (4) Date: Oct. 12, 2001

(87) PCT Pub. No.: WO00/61477

PCT Pub. Date: Oct. 19, 2000

(30) Foreign Application Priority Data

Apr. 12, 1999 (IT) ..... TO99A0281

(51) Int. Cl.[7] ..... B65H 3/06

(52) U.S. Cl. ..... 271/124; 271/121; 271/114; 271/109; 271/21

(58) Field of Search ..... 271/19, 10, 109, 271/114, 21, 115, 121, 122, 245, 246

(56) References Cited

U.S. PATENT DOCUMENTS 4,223,884 A 9/1980 Burnham et al.
5,004,217 A * 4/1991 Kano et al. ..... 271/10.11
5,181,708 A * 1/1993 Ruch ..... 271/21
5,181,712 A * 1/1993 Perino ..... 271/109
5,419,543 A * 5/1995 Nakamura et al. ..... 271/9.01
5,593,150 A * 1/1997 Katayanagi et al. ..... 271/121
6,296,245 B1 * 10/2001 Donnis et al. ..... 271/122

FOREIGN PATENT DOCUMENTS

EP 0 838 418 4/1998
EP 0 873 876 10/1998
GB 2182315 A * 7/1987
WO WO 98/23513 * 6/1998

* cited by examiner

*Primary Examiner*—Christopher P. Ellis
*Assistant Examiner*—Patrick Mackey
(74) *Attorney, Agent, or Firm*—Banner & Witcoff, Ltd.

(57) ABSTRACT

A device (10) for feeding sheets from a ream (22) comprising a main feeding roller (24) subdivided into a plurality of sleeves (32) which rotate in contact with an uppermost sheet (23*a*), coming from the ream, to feed it along a path (30), and an auxiliary separating roller (26) adapted for separating the uppermost sheet (23*a*) from the other sheets of the ream (22), wherein the feeding and separating rollers (24, 26) are both arranged on the same side with respect to said path (30) and therefore rotate in contact with one and the same side of the uppermost sheet (23*a*). The separating roller (26) is accommodated in a central seat (34) made between the sleeves (32) of the main feeding roller (24) and is arranged prevalently inside the radial working envelope of the sleeves (32) of the main feeding roller (24), so that the feeding device (10) has an extremely compact structure.

8 Claims, 6 Drawing Sheets

DEVICE FOR FEEDING SHEETS FROM A REAM OF THE TYPE COMPRISING A MAIN FEEDING ROLLER AND AN AUXILIARY SEPARATING ROLLER

This is a U.S. National Phase Application Under 35 USC 371 and applicant herewith claims the benefit of priority of PCT/IT00/00123 filed Apr. 5, 2001, which was published Under PCT Article 21(2) in English and Application No. T099A000281 filed in Italy on Apr. 12, 1999.

FIELD OF THE INVENTION

This invention relates in general to a device adapted for picking and feeding a sheet at a time from a ream and particularly suited for being applied in office equipment, such as for example a facsimile machine.

In greater detail, the device of the invention is of the type comprising a main rotating feeding roller suitable for receiving in contact an uppermost sheet of the ream for feeding it and imparting to it a predetermined feeding direction along a path, and at least one auxiliary separating roller arranged adjacent to and cooperating with the main feeding roller, by rotating in contact with the uppermost sheet, in order to produce a correct separation of the latter from the other sheets of the ream.

TECHNICAL BACKGROUND

Various feeding devices are known in the current art that adopt a structural arrangement such as that described above, or at any rate fairly similar to it, based essentially on the cooperation between a main feeding roller which rotates in contact with the sheets of a ream and which determines positively their feeding along a path, and an auxiliary separating roller also rotating in contact with the sheets in such a way that the sheets are correctly separated one at a time from the ream and fed along the path.

One of these devices is for example incorporated in the printer which is described in the European patent application, in the name of the Applicant, published with No. EP 0 873 876, and which is currently marketed under the product name "Artjet".

This known device comprises a main feeding roller and an auxiliary roller also called rejection roller, wherein both the main feeding roller and the rejection roller consist of a shaft bearing coaxially a plurality of rollers, called respectively feeding rollers and rejection rollers. The main feeding roller and the rejection roller are arranged parallel and side by side one another, but at opposite ends with respect to the sheet path so that, while the printer is in operation, they each rotate in contact with a respective face of the sheet which is being fed.

In particular, the main feeding roller with its rotation determines the feeding direction of the sheets, whereas the rejection roller rotates in the opposite direction to this feeding direction, to prevent the feeding of more than one sheet at a time from a ream.

Though reliable, this device does come with the disadvantage of having a structure that is rather cumbersome and at any rate not very suitable for the production of a device for the feeding of sheets from a ream, that is very compact and characterized by having low dimensions.

From U.S. Pat. No. 4,223,884 it is known an apparatus for feeding sheets from a stack comprising a feed roller mounted for rotation about a longitudinal axis, and a second roller mounted for rotation within the feed roller about a second axis which is parallel to such longitudinal axis, wherein the feed roller and the second roller are made to rotate simultaneously in opposite directions about their respective axes in order first to separate a sheet and then to feed the same sheet from the stack. This apparatus appears as being rather complex and expensive.

From patent EP 0 838 418 A it is known a sheet feeder comprising a sheet feed roller which rotates in a feed direction for feeding a sheet from a hopper, and a separation pad which cooperates with the sheet feed roller for separating the sheet which is fed from the next sheet. After the sheet is fed, the sheet feed roller is made to rotate in an opposite direction and the separation pad is brought out of contact with the sheet feed roller, while a sheet reset lever is pivoted so as to return the next sheet to the hopper. Also this feeder has a structure rather complex and expensive.

SUMMARY OF THE INVENTION

The object of this invention is therefore that of producing a device for the feeding of single sheets from a ream, of the type comprising an auxiliary separating roller cooperating with a main feeding roller, which eliminates the limitations and drawbacks present in similar devices made previously, and which most importantly has a very compact structure. This object is attained by the device for the feeding of single sheets from a tray having the characteristics defined in the main claim.

BRIEF DESCRIPTION OF THE DRAWINGS

These and other characteristics, objects and advantages of the present invention will be apparent from the description that follows of a preferred embodiment, provided purely by way of an illustrative, non-restrictive example, and with reference to the accompanying drawings, where.

PREFERRED MODE FOR CARRYING OUT THE INVENTION

Figure 1:
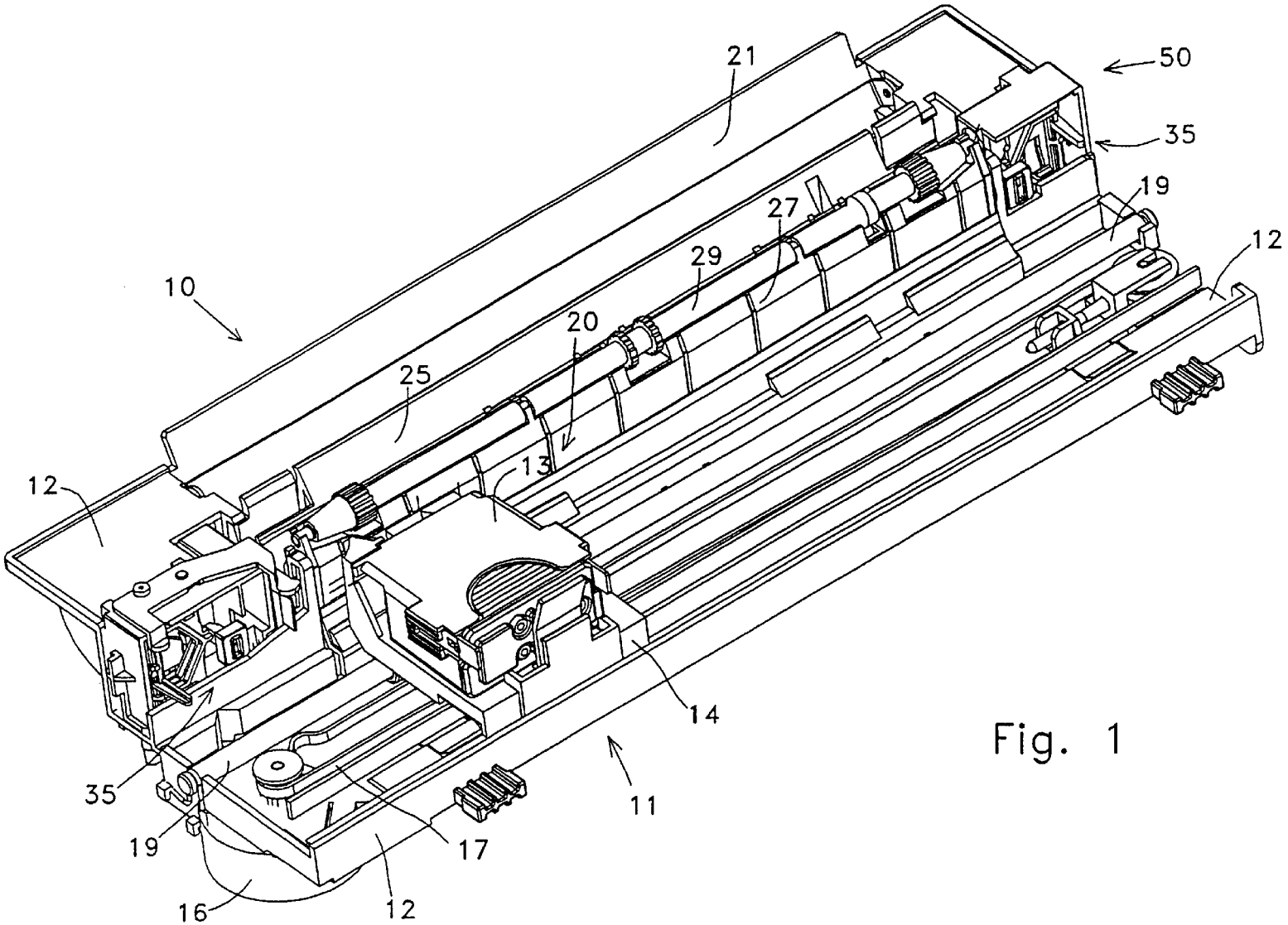
FIG. 1 is a perspective view of a printer incorporating a device according to this invention for feeding a single sheet at a time from a ream accommodated in a tray.

With reference to FIG. 1, a device according to this invention for the feeding of sheets from a ream is generically indicated with the numeral 10, and is incorporated in office equipment, such as a facsimile machine. This office machine, generically indicated with the numeral 50, is mostly visible in FIG. 1, and typically comprises a printing group or printer 11, in turn provided with a printhead 13 operating, for example, on the basis of the ink jet technology, and a fixed structure 12, also shared by the device 10, bearing the various mechanisms of the printer 11.

In particular the mechanism of the printer 11 comprises a transport mechanism adapted for transversally moving the head 13 back and forward in front of a printing zone 20, and at least one device for the maintenance 35 of the ink jet head 13.

In particular, the transport mechanism comprises a motor 16, and a carriage 14, in turn bearing the head 13 and linked to the motor 16 by way of a belt 17, which is fitted slidingly on a guide 19 attached on the fixed structure 12.

Figure 2:
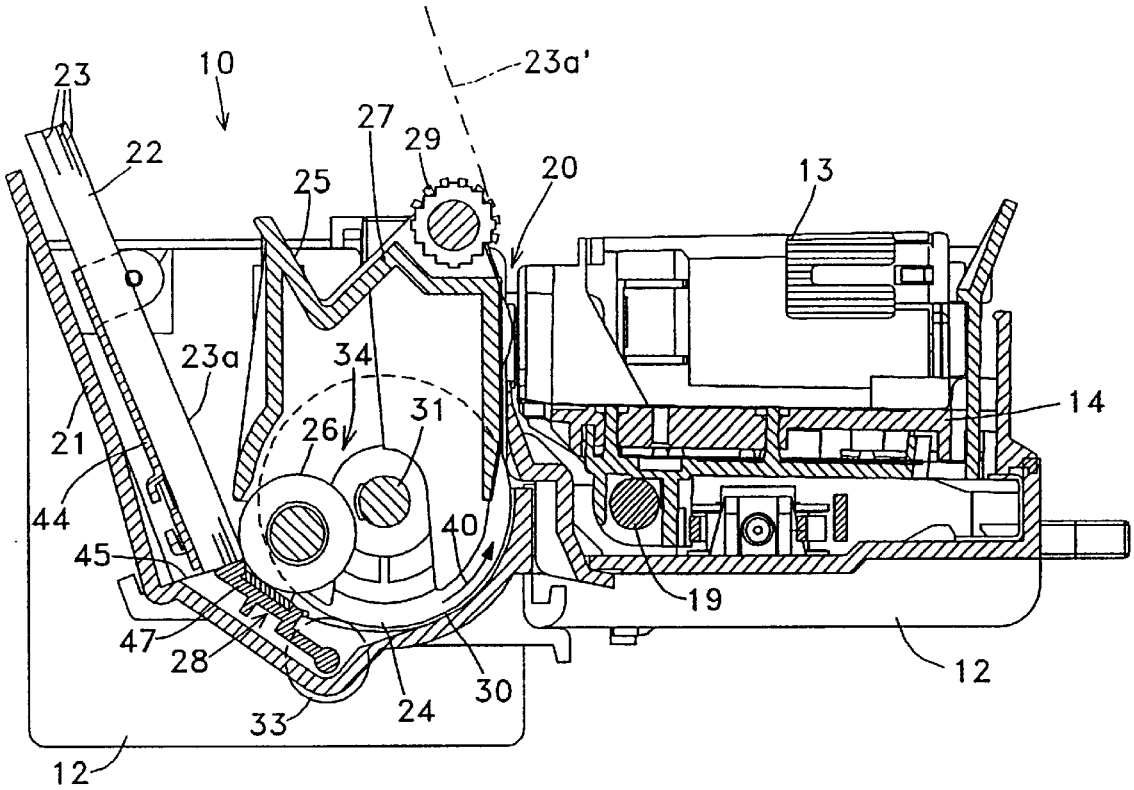
FIG. 2 is a section, along a longitudinal, central plane, of the device of FIG. 1.

With reference to FIG. 2, the feeding device 10 comprises a tray 21 which accommodates a ream 22 consisting of a plurality of sheets 23; a printing path 30 extending between an entrance zone and an exit zone of the feeding device 10 and crossing the printing zone 20; a frame 27 mounted on the structure 12 in such a way as to be able to be extracted, where necessary, from the same structure 12 to grant an operator access to the path 30; a main feeding roller 24 and an auxiliary separating roller 26 arranged on the same side with respect to the printing path 30 and both mounted rotatingly on the frame 27; a pressure device 28 borne by the structure 12 to press the sheets 23 against the separating roller 26; and, in the exit zone of the device 10, an ejecting roller 29 and a collection tray 25 adapted respectively for ejecting and collecting the sheets 23 after they have been printed in the printing zone 20 by the head 13.

The ream 22 consists of a variable number of sheets 23 of various types, and for example, when it is full, of at least 50 sheets having a grammage of between 70 and 90 g/m$^2$.

The sheets 23, once extracted from the ream 22, are adapted for advancing along the printing path 30 according to the feeding direction 40, corresponding to the anticlockwise rotation of the main feeding roller 24, as described in greater detail below.

The feeding tray 21 is at least in part formed from the structure 12 and has a substantially vertical orientation or at any rate upwardly inclining, so that the ream 22, when it is accommodated in the tray 21, sits by the bottom on account of its own weight against a bottom wall 45 of the tray 21.

A blade 44, fulcrum-mounted on the tray 21, constitutes a lateral support for the ream accommodated in the tray 21, and has the function of constantly pressing, urged by resilient means not shown in the drawings, a lower edge of the ream 22 towards the feeding roller 24 and the separating roller 26.

Figure 3:
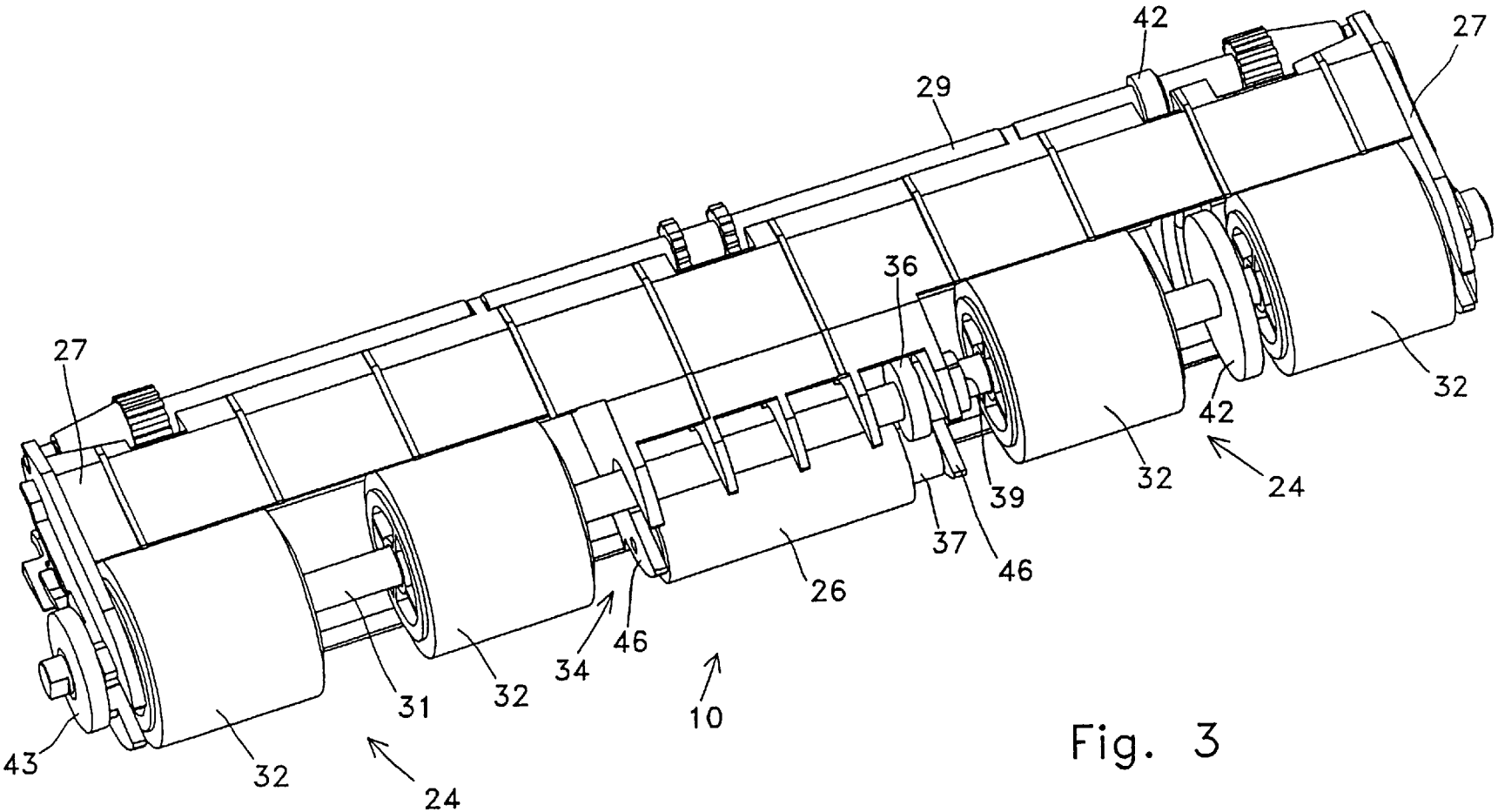
FIG. 3 is a first partial, perspective view in enlarged scale of the device of FIG. 1.
Figure 4:
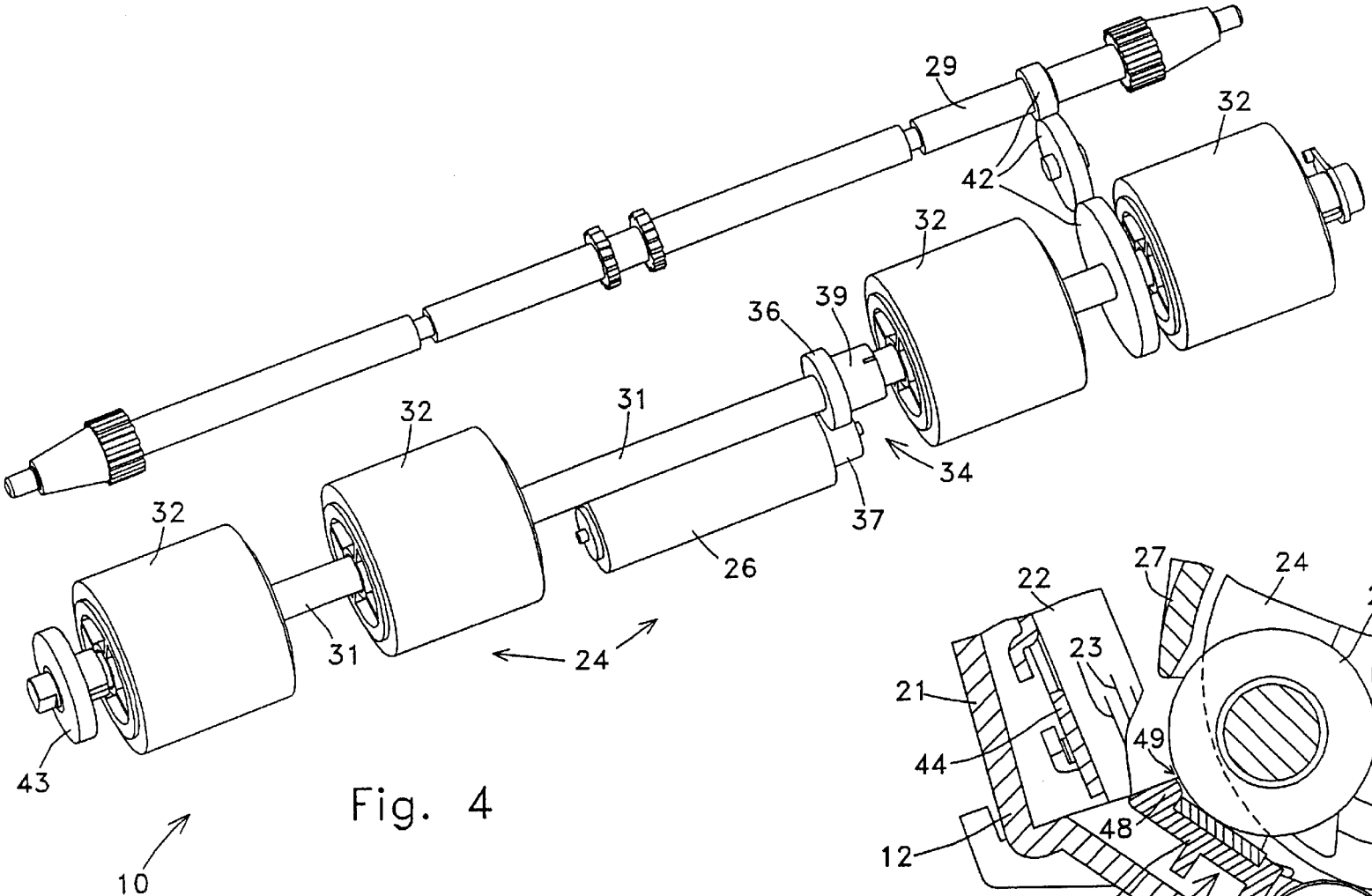
FIG. 4 is a second perspective view similar to that of FIG. 3, but with a number of parts removed.

As is clearly shown in the FIGS. 3 and 4, the main feeding roller 24 possesses a sectored structure, and is comprised of a shaft 31 disposed parallel to the surface of the sheets 23, and a plurality of feeding rollers or sleeves 32, for example four, attached integrally upon the shaft 31.

Each roller 32 cooperates in contact with a corresponding counter-rotating roller 33, free to rotate on the structure 12 and appropriately pressed against the roller 32, for example by a spring or equivalent resilient means.

The function of the auxiliary separating roller 26 is that of cooperating with the main feeding roller 24 to allow the correct feeding of the sheets from the ream 22 accommodated in the tray 21, in particular preventing double sheets from being picked from the ream 22.

The separating roller 26, unlike the main feeding roller 24, does not have a sectored structure, but is made instead of a single roller, which is accommodated in a central zone or compartment 34 extending along the main feeding roller 24 and delimited laterally by the two sleeves 32 closest to the centre of the main feeding roller 24.

In particular, as shown in FIG. 2, the separating roller 26 is accommodated, in the zone 34, prevalently inside the work envelope whether laterally or radially of the feeding roller 24, between the shaft 31 and the periphery of the sleeves 32, so that only a small portion of the separating roller 26 protrudes outside the sleeves 32.

This disposition of the auxiliary separating roller 20 in relation to the main feeding roller 24 is extremely advantageous, being such as not to substantially entail an additional encumbrance with respect to that of the main feeding roller 24, so that the feeding device 10 assumes as a whole a very compact, low volume structure.

The auxiliary separating roller 26 is mounted rotatingly at the ends on protrusions 46 (FIG. 3) of the frame 27, and is driven in its rotation by the main feeding roller 24 through a pair of gearwheels 36 and 37.

Whereas the gearwheel 37 is integral with the auxiliary separating roller 26, the gearwheel 36 is mounted on the shaft 31 with the interposition of a monodirectional clutch or free wheel 39, the function of which is to permit the transmission of rotation from the feeding roller 24 to the separating roller 26, in one direction only and not in the opposite one, as will be described in greater detail below.

The main feeding roller 24 is also adapted to impart the rotation to the ejecting roller 29 through a set of three gearwheels 42, as shown in FIG. 4.

In particular the two gearwheels 42 arranged at the ends of the set are integral respectively with the shaft 31 and with the ejecting roller 29, whereas the intermediate one is mounted idling on the frame 27.

The ejecting roller 29 is provided with sleeves serrated on the periphery so as to grip effectively, while rotating in the anti-lockwise direction, the exiting edge of the sheets 23, after they have been printed in the printing zone 20, thereby determining the ejection of the sheets 23 into the collection tray 25.

Figure 5:
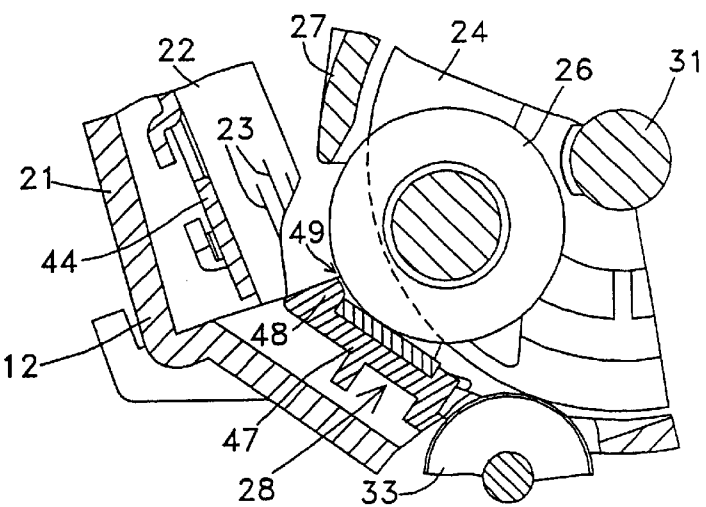
FIG. 5 is an enlarged scale view, showing in detail a zone of FIG. 2.

As seen in FIG. 5, the pressure device 28 comprises a sliding block 47 which extends parallel to the separating roller 26 and is pressed against the latter under the action of known resilient means, not depicted in the drawings.

In addition, the sliding block 47 is provided, in an entrance zone of the sheets 22, with a slightly protruding profile 48 defining with the separating roller 26 an entrance section 49 having a very low height, of the same order of magnitude as the thickness of the sheets 23 comprising the ream 22.

The profile 48 therefore has the purpose of intercepting the sheets 23, in excess with respect to the uppermost sheet 23*a*, coming from the ream 22, and accordingly of preventing the feeding of double sheets through the entrance section 49.

Figure 6:
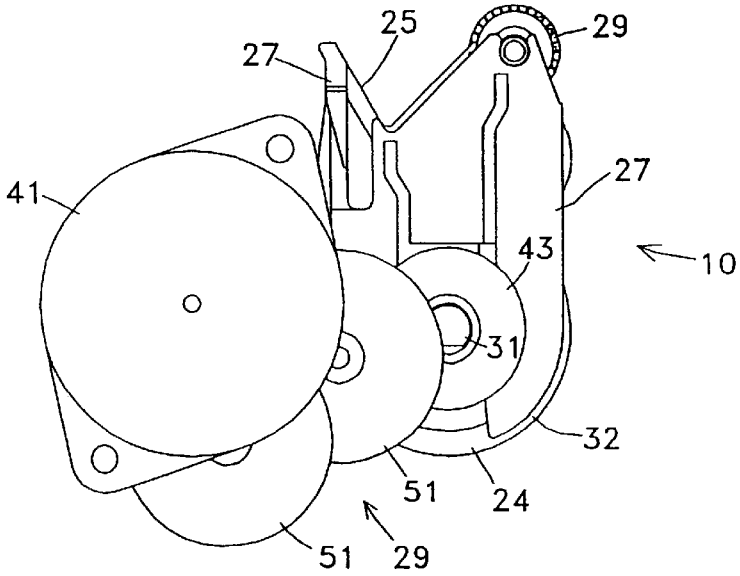
FIG. 6 is a lateral view, obtained by removing some external parts, of the device of FIG. 1.

With reference to FIG. 6, the feeding device 10 is adapted for being driven by a motor mechanism comprising a feeding motor 41 and a chain of gearwheels 51 which link the feeding motor 41 to a gearwheel 43 attached to one end of the shaft 31 of the main feeding roller 24.

In this way, the motor 41 is suitable for commanding the rotation not only of the main feeding roller 24, but also of the separating roller 26, and of the ejecting roller 29.

The operation of the device 10 described up to now is as follows.

To begin with, the ream 22 is accommodated by an operator in the tray 21, in such a way that the uppermost sheet 23*a* of the ream 22 presses by the bottom, under the action of the blade 44, against the auxiliary separating roller 26.

The device 10 has a cyclical type operation and comes into action when, within the wider scope of the operating cycle of the printer 11, it is necessary to feed a new sheet from the ream 22.

In this case, the motor 41 starting from an idle condition, rotates in such a way as to determine, with reference to FIG. 2, a corresponding rotation in the clockwise direction of the main feeding roller 24.

This clockwise rotation of the feeding roller 24 commands, by means of the gearwheels 36 and 37 and of the monodirectional clutch 39 which maintains the gearwheel 36 and the shaft 31 in integral engagement, a corresponding anti-clockwise rotation of the separating roller 26.

In this way the uppermost sheet 23*a* is made slide and therefore separated from the underlying sheets of the ream 22, and also fed, crossing the entrance section 49, along the path 30 between the sliding block 47 and the auxiliary separating roller 26.

The anti-clockwise rotation of the auxiliary separating roller 26 is of predetermined entity, corresponding to a determined rotation of the motor 41, and is such as to bring an entering edge of the uppermost sheet 23*a* to stop against the main feeding roller 24, in correspondence with a gripping zone between the same feeding roller 24 and the counter-rotating rollers 33.

At this point, the motor 41 inverts its direction of rotation, determining as a result a rotation in the anti-clockwise direction of the feeding roller 24 and simultaneously, via the monodirectional clutch 39, the disassociation in the rotation of the main feeding roller 24 from the auxiliary separating roller 26.

The sheet 23*a* is thus gripped between the rollers 31 of the main feeding roller 24 and the counter-rotating rollers 33, and fed along the path 30 in accordance with the anti-clockwise rotation of the feeding roller 24, whereas at the same time the separating roller 26, being now disengaged from the shaft 31, is dragged into anti-clockwise rotation by the feeding motion of the sheet 23*a*.

The sheet 23*a* continues to advance along the path 30 in accordance with the feeding direction 40 until it comes to the printing zone 20, where the sheet 23*a* is printed by the head 13 in a known way.

In this step, the auxiliary separating roller 26 continues to be dragged in the anti-clockwise rotation by the sheet 23*a,* and this anticlockwise rotation continues until the sheet 23*a* comes into contact with the same separating roller 26.

In particular, at the time when the exiting edge of the sheet 23*a* goes beyond the zone of contact between the auxiliary separating roller 26 and the sliding block 47, the separating roller immediately ceases to rotate.

At the same time, the anti-clockwise rotation of the main feeding roller 24 determines, through the gearwheels 42, a corresponding anti-clockwise rotation of the ejecting roller 29, such as to accompany the sheet 23*a* towards the collection tray 27.

In detail, when the sheet 23*a* has been fully printed and is disposed roughly as indicated with the dot and dash line in FIG. 2, in the position 23*a*', the ejecting roller 29 engages with its outer serrated surface with the exiting edge of sheet 23*a* to transfer it to the collection tray 25.

Figure 7:
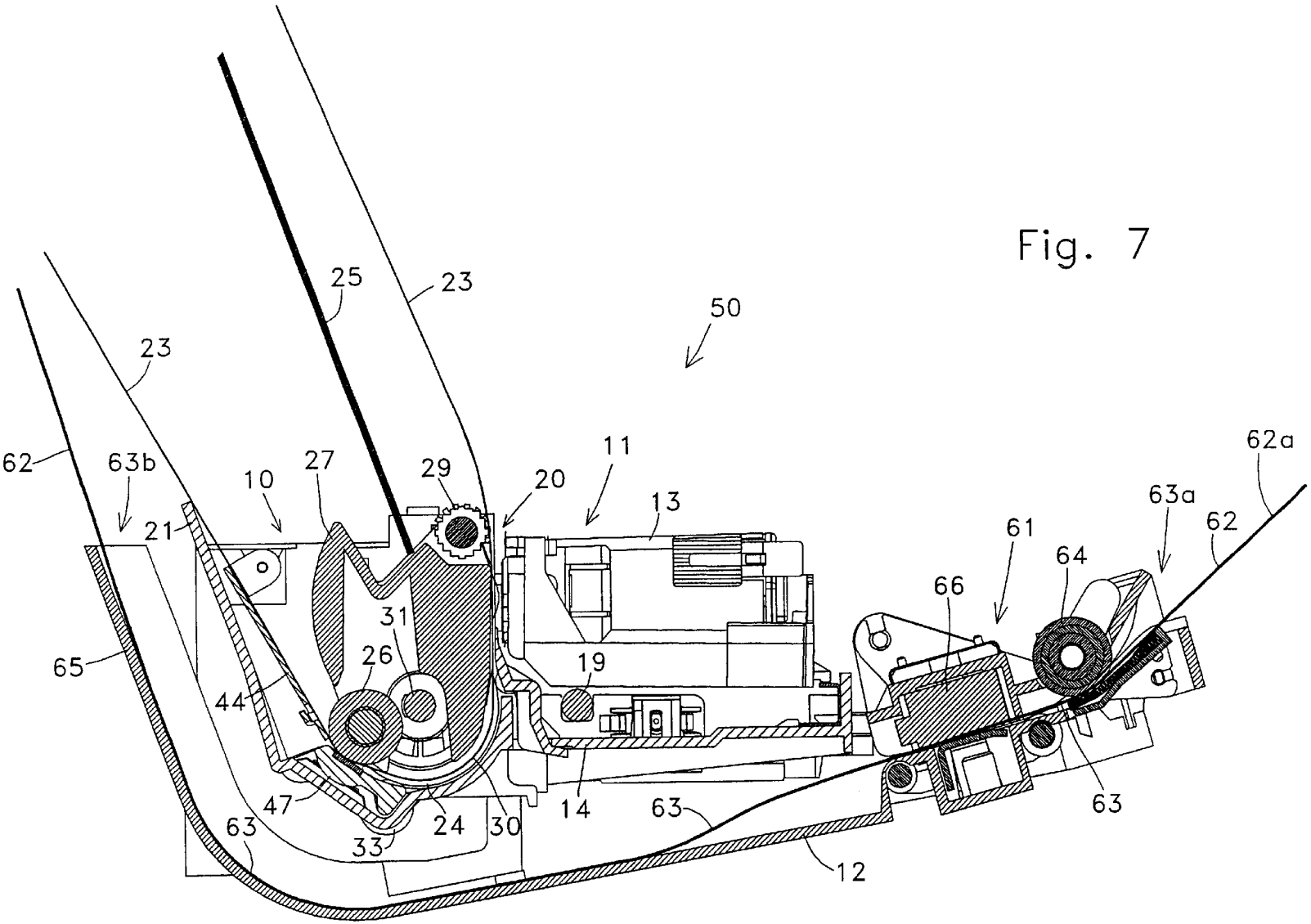
FIG. 7 is a schematic section of a first model of a facsimile machine incorporating the device of the invention for feeding sheets from a ream.

As already said, the office equipment 50 which incorporates the device 10 preferably consists of a facsimile machine, and therefore typically also comprises, in addition to the printing group 11 already described in detail above and adapted for printing the generally blank sheets 23 of the ream 22, a reading group 61 adapted for reading already printed, original sheets 62, as shown in FIG. 7.

The same FIG. 7 schematically illustrates how the blank sheets 23 and the original sheets 62 are handled within the context of a first model of a facsimile machine indicated with the numeral 50.

The blank sheets 23 are placed to begin with, as already said, in the tray 21, which is in turn disposed in a rear zone of the facsimile machine 50, that is to say in a zone opposite to that at which the user of the facsimile machine 50 normally operates.

Again the sheets 23 are picked from the tray 21, to be fed subsequently along the printing path 30, and cross through the printing zone, where the printing group 11 prints on the sheets 23 information received by the facsimile machine 50 from the outside through a line to which the facsimile machine 50 is connected.

The printing path 30 has roughly a U shape, determined essentially by the main feeding roller 24, and is such that the sheets 23 appear, after having been printed, with their printed face facing a front zone of the facsimile machine 50, that is to say towards the operator of the facsimile machine 50.

As is typical of all facsimile machines, the original sheets 62 on the other hand are not printed, but are handled rather with the object of reading, through the reading group 61, the information already printed thereon, so as to send it subsequently to the outside via the line connected to the facsimile machine 50.

In particular the original sheets 62 are adapted for advancing in front of the reading group 61 along a reading path 63, which extends from an entrance zone 63*a,* where the original sheets 62 are initially introduced manually by the facsimile machine operator into the path 63, to an exit zone 63*b* where the sheets 62 are collected in a collection tray 65, after having been read by the reading group 61.

The original sheets 62 are introduced into the path 63 with their printed face 62*a* facing upwards, i.e. towards the operator of the facsimile machine 50, who thus has the possibility, for example, of comfortably reading the fax number printed on this printed face 62*a* so as to be able to type it on the keyboard of the facsimile machine 50.

The entrance zone 63*a* is disposed in correspondence with the front part of the facsimile machine 50, i.e. in front of the operator of the facsimile machine, whereas the exit zone is local to the rear part of the facsimile machine, opposite that adjacent to the operator.

Furthermore, the path 63 has an curving trajectory, which is defined at least in part by the fixed structure of the facsimile machine 50 and which extends externally roughly around the path 30 of the blank sheets 23.

In particular, the original sheets 62, after having been introduced initially into the path 63, are made advance along the latter in a known way in front of the reading group 61, for example by means of a motor-driven roller 64.

The reading group 61 is structured in such a way as to have a reading unit 66 disposed upwardly with respect to the reading path 63, so as to allow, as already said, the original sheets 62 to be introduced manually with their printed face facing upwards.

The disposition of the reading path 63 with respect to the printing path 30, as clearly shown in FIG. 7, is particularly advantageous as it allows the operator of the facsimile machine 50 to comfortably introduce the original sheets 62 from the front zone of the facsimile machine 50 and take them, after reading, from the rear zone of the latter. In addition, the printing path 30 and the reading path 63 are completely distinct from one another without any portions in common, so that in particular the reading path is not subject to get dirty or to be contaminated by the printing process. Also it is possible to simultaneously feed an original sheet 62 for reading and a blank sheet for printing. The overall dimensions of the facsimile machine 50 are also low.

Figure 8:
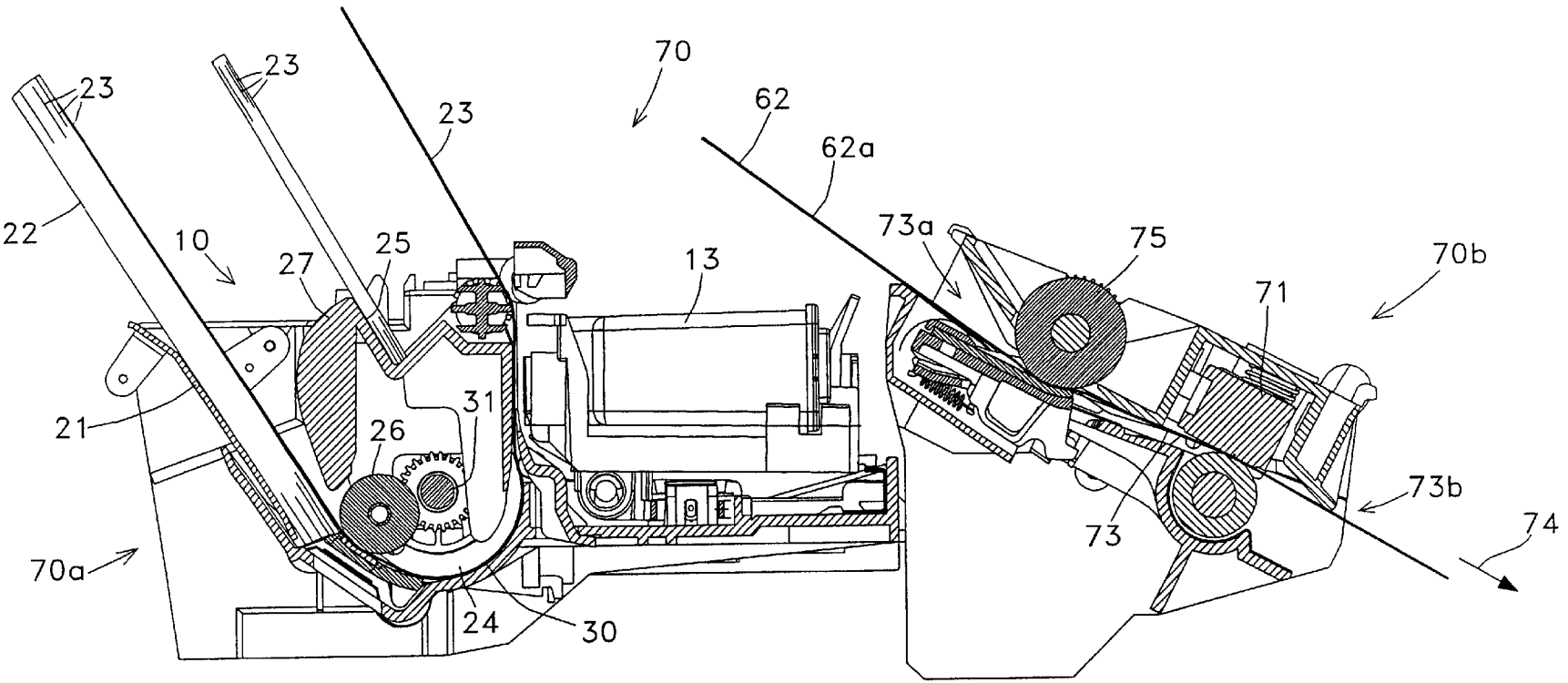
FIG. 8 is a partial and schematic section of a second model of a facsimile machine incorporating the device of the invention.

FIG. 8 demonstrates schematically how the blank sheets 23 and the original sheets 62 are handled within the context of a second model of facsimile machine, indicated with the numeral 70 and incorporating the device 10 of the invention, wherein, for simplicity's sake, the parts corresponding to the model of facsimile machine 50 are indicated using the same reference numerals.

The device 10 is incorporated in a rear portion 70*a* of the facsimile machine 70, opposite to that adjacent to the operator, and is adapted for handling the blank sheets 23 in the same way as already described in relation to the model of facsimile machine 50.

In particular the blank sheets 23, after having been picked from a ream 22 accommodated in a tray 21, advance through a printing path 30 having roughly a U shape, defined essentially by the main feeding roller 24 of the device 10, and, after printing by means of the printhead 13, are placed in a collection tray 25, with their printed face facing a front zone of the facsimile machine 70.

Unlike the facsimile machine 50, the facsimile machine 70 has on the other hand a reading path 73, roughly linear, for the original sheets 62, which extends integrally along a frontal portion 70*b* of the facsimile machine 70, in front of the operator of the facsimile machine itself.

In particular, in practice, the original sheets 62 are initially placed manually by the operator in an entrance zone 73*a,* from where they are picked up by a motor-driven roller 75 which determines the feeding of the original sheets 62 along the reading path 73, in the direction indicated by an arrow 74.

In this way, the original sheets 62 pass in front of a reading group 71, disposed above the reading path 73, to be read, and then come to an exit zone 73*b*, where the original sheets 62 are in one way or another collected.

As before with the facsimile machine 50, the reading group 71 is structured in such a way that the original sheets 62 must be fed into the path 73 with their printed face 62*a* facing upwards, i.e. towards the operator of the facsimile machine 70, who thus has the possibility of reading the information printed on the original sheet 62, while the latter is placed in the entrance zone 73*a*.

It remains understood that changes and/or improvements may be made to the device for feeding sheets from a ream described up to now, without departing from the scope of this invention as defined in the appended claims.

What is claimed is:

1. Device (10) for the feeding of sheets (23) from a ream (22), comprising:

a main feeding roller (24) provided for rotating in contact with an uppermost sheet (23*a*) of said ream (22) in order to feed it and impart to it a predetermined feeding direction along a path (30), and at least one auxiliary separating roller (26) arranged adjacently to said main feeding roller (24) and also provided for rotating in contact with said uppermost sheet (23*a*), said auxiliary separating roller (26) being provided for cooperating with said main feeding roller (24) in order to correctly separate said uppermost sheet (23*a*) from the other sheets (23) of the ream (22), wherein said main feeding roller (24) and said auxiliary separating roller (26) are arranged on the same side with respect to said uppermost sheet (23*a*), so that said rollers (24, 26) cooperate in contact with a same face of said uppermost sheet (23*a*), and said auxiliary separating roller (26) is accommodated, at least partly, inside the work envelope radially of said main feeding roller (24), characterised in that said main feeding roller (24) is adapted for rotating, during a feeding cycle of said uppermost sheet (23*a*), in two directions of rotation, respectively a first direction of rotation and a second direction of rotation opposite to said first direction of rotation, said second direction of rotation corresponding to said predetermined feeding direction (40) of said uppermost sheet (23*a*) along said path (30), whereby, during a first starting step of said cycle, said main feeding roller (24) rotates according to said first direction of rotation, while simultaneously said auxiliary separating roller (26), by rotating in contact with said uppermost sheet (23*a*), positively commands feeding thereof in such a way as to bring it into engagement with said main feeding roller (24), and whereby subsequently, during a second step of said cycle, said main feeding roller (24) inverts its direction of rotation in order to rotate according to said second direction of rotation and impart said predetermined feeding direction (40) to said uppermost sheet (23*a*) along said path (30), while at the same time said auxiliary separating roller (26) ceases to command the feeding of said uppermost sheet (23*a*).

2. Device according to claim 1, characterized in that said auxiliary separating roller (26) is associated in the rotation with said main feeding roller (24) through a monodirectional clutch, so that when said main feeding roller (24) rotates according to said first direction of rotation said separating roller is positively rotated by said main feeding roller, whereas when said main feeding roller inverts its direction of rotation in order to rotate according to said second direction of rotation (40), said auxiliary separating roller (26) disassociates itself in the rotation from said main feeding roller (24) and consequently is dragged by friction into rotation by said uppermost sheet (23*a*).

3. Device according to claim 1, wherein said main feeding roller (24) is divided into a plurality of sleeves (32) mounted on a shaft (31), characterized in that said auxiliary separating roller (26) is disposed in a zone (34) extending centrally along said main feeding roller (24) and delimited laterally by two sleeves (32) of said main feeding roller (24).

4. Device according to claim 1, characterized in that it further comprises pressing means (28) cooperating in a pressure relationship with said auxiliary separating roller (26), said pressing means (28) and said auxiliary separating roller (26) being adapted for receiving therebetween the sheets (23) coming from said ream (22).

5. Device according to claim 4, characterized in that said pressing means (28) consist of a sliding block (47) pressed elastically against said auxiliary separating roller (26), wherein said sliding block (47) defines with said auxiliary separating roller (26) a passage section (49) having a low height and suitable or permitting the passage of one sheet only at a time coming from said ream.

6. Device according to claim 5, characterized in that it further comprises a ray (21) suitable for accommodating said ream (22) and disposed in a substantially vertical direction, or at any rate upwardly inclining, so that said ream (22), when it is accommodated in said tray (21), sits by the bottom on account of its own weight against said auxiliary separating roller (26), in correspondence with a zone adjacent to said passage section (49).

7. Device according to claim 1 further comprising a frame (27) whereon said main feeding roller (24) and said auxiliary separating roller (26) are rotatingly mounted, characterized in that said frame is adapted for being fitted removably with respect to the structure (12) of office equipment (50) incorporating said device (10).

8. Office equipment (50, 70) characterized in that it comprises a device (10) according to any one of the previous claims.

* * * * *